US006670771B2

(12) United States Patent
Shin et al.

(10) Patent No.: US 6,670,771 B2
(45) Date of Patent: Dec. 30, 2003

(54) ORGANIC ELECTROLUMINESCENCE DISPLAY AND DRIVING METHOD AND APPARATUS THEREOF

(75) Inventors: Dong-Yong Shin, Seoul (KR); Oh-Kyong Kwon, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/365,244

(22) Filed: Feb. 12, 2003

(65) Prior Publication Data

US 2003/0178947 A1 Sep. 25, 2003

(30) Foreign Application Priority Data

Mar. 21, 2002 (KR) ..... 2002-15438

(51) Int. Cl.[7] ..... G09G 3/10

(52) U.S. Cl. ..... 315/169.2; 315/169.3; 345/98; 345/100

(58) Field of Search ..... 315/169.1–169.3; 345/36, 42, 45, 76, 98, 100

(56) References Cited

U.S. PATENT DOCUMENTS 4,996,523 A * 2/1991 Bell et al. ..... 345/77
6,288,496 B1 * 9/2001 Suzuki et al. ..... 315/169.3

FOREIGN PATENT DOCUMENTS

EP 1274065 A2 * 1/2003 ..... G09G/3/32

* cited by examiner

*Primary Examiner*—Haissa Philogene
(74) *Attorney, Agent, or Firm*—Christie, Parker & Hale, LLP

(57) ABSTRACT

In an organic EL display, a scan driver is divided into several scan driving units, and the each scan driving unit includes a plurality of flip-flops and a plurality of buffer units each receiving an output of the flip-flop as an input. The flip-flop includes four NOR gates and the buffer unit includes an OR gate composed of a NOR gate and an inverter, and a buffer composed of two inverters. The NOR gates of the flip-flop and the buffer unit receive a clear signal and are composed of PMOS transistors. When the clear signal of high level is applied to non-operating ones of the scan driving units, outputs of the NOR gates become low level, and thereby, it is possible to remove static currents generated in output terminals of the NOR gates.

19 Claims, 7 Drawing Sheets

ORGANIC ELECTROLUMINESCENCE DISPLAY AND DRIVING METHOD AND APPARATUS THEREOF

CROSS REFERENCE TO RELATED APPLICATIONS

This application claims priority to and the benefit of Korea Patent Application No. 2002-0015438 filed on Mar. 21, 2002 in the Korean Intellectual Property Office, the contents of which are incorporated herin by reference.

BACKGROUND OF THE INVENTION (a) Field of the Invention

The present invention relates to an organic electroluminescence (hereinafter, "EL") display and a scan driver, and, more particularly, to an organic EL display and a scan driver with low power consumption.

(b) Description of the Related Art

In general, an organic EL display is a display that emits light by electrical excitation of fluorescent organic compound and displays images by driving each of M×N organic luminescent cells with voltage or current.

The organic cell has a structure of an anode (ITO), an organic thin film and a cathode layer (metal). The organic thin film is formed as a multi-layered structure including an emission layer ("EML"), an electron transport layer ("ETL"), and a hole transport layer ("HTL") so as to increase luminescence efficiency by balancing electron and hole concentrations. In addition, it can include an electron injection layer ("EIL") and a hole injection layer ("HIL") separately.

Organic EL displays that use organic luminescent cells like the above are configured as a passive matrix or an active matrix that includes thin film transistors (TFTs). In the passive matrix configuration, organic luminescent cells are formed between anodes and cathodes lines that cross each other and are driven by driving those lines. While in the active matrix configuration, each organic luminescent cell is coupled to a TFT usually through ITO electrode and are driven by controlling the gate voltage of the corresponding TFT.

The organic EL display is generally composed of an organic EL display panel, a scan driver, and a data driver. The organic EL display panel includes a plurality of data lines transmitting data signals representing image signals, a plurality of scan lines transmitting selection signals and pixel circuits provided in pixel areas defined by two adjacent data lines and two adjacent scan lines. When the scan driver applies the selection signals to the scan lines, transistors are turned on by the selection signals, and then, the data signals representing the image signals are applied to gates of driving transistors from the data driver through the data lines, and currents flow through organic EL devices via the transistors in correspondence to the data signals applied to the gates thereof. Thereby, lights are emitted.

In this case, as shown in FIG. 1A, the scan driver is composed of master-slave type flip-flops and NAND gates, and each flip-flop includes four inverters as shown in FIG. 1B. If inverters and NAND gates composed of PMOS transistors or NMOS transistors, which are easy to manufacture compared with CMOS transistors, are used, static currents flow.

FIGS. 2A and 2B are circuit diagrams to represent output parts where the static currents are generated when PMOS transistors or NMOS transistors are used in the inverters or NAND gates.

As shown in FIG. 2A, in the case where logic circuits are composed of PMOS transistors, when a load is attached to GND side, and output $V_{out}$ is high level, the static currents flow. As shown in FIG. 2B, in the case where logic circuits are composed of NMOS transistors, when a load is attached to VDD side, and output $V_{out}$ is low level, the static currents flow. Accordingly, when the inverter using PMOS transistors has a low level input and when the NAND gate using PMOS transistors has at least one low level input, the output thereof is high level, and thereby the currents flow. However, in case of a flip-flop composed of four inverters, two inverters receive low level inputs and the other two inverters receive high level inputs. Thus, the static currents always flow in the half of the inverters within the flip-flop.

In the organic EL display panel, so as to use PMOS transistors connected to the scan lines as normally-off switches, inputs applied to the PMOS transistors, i.e., outputs of NAND gates (in case of being composed of PMOS transistors) must become high levels. Accordingly, the static currents flow in the NAND gates during most of time.

When the static currents flow as above, there is a problem that static power loss is increased, and thereby power consumptions are increased in the scan driver.

SUMMARY OF THE INVENTION

In accordance with the present invention power consumption is decreased by reducing static currents in a scan driver.

A scan driver is divided into several parts and a clear signal is applied to a non-operating scan driver.

An organic EL display according to the present invention includes an organic EL display panel, a data driver applying data signals to data lines, and a scan driver applying selection signals to scan lines. The organic EL display panel includes a plurality of scan lines transmitting selection signal, a plurality of data lines transmitting data signals representing image signals, and a plurality of pixel circuits coupled to the scan lines and the data lines.

The scan driver is composed of more than two scan driving units and a selection controller generating clear signals, and each scan driving unit includes a plurality of flip-flops coupled with each other in series and a plurality of buffer units receiving outputs of the flip-flops to drive the respective scan lines. Each of the flip-flops is composed of a plurality of logic gates (NOR gates or NAND gates) and a plurality of switching elements. The clear signals keep outputs of logic gates of scan driving units as a constant value for the scan driving units not to generate the selection signal.

The flip-flop is composed of a first to a fourth logic gates, and the first logic gate receives the clear signal and output of the previous flip-flop, inputted through a first switching element, as input. A second logic gate receives the output of the first logic gate and the clear signal as input, and the output terminal of the second logic gate is coupled via a second switching element to the output of the previous flip-flop inputted through the first switching element. A third logic gate receives the clear signal and the output of the first logic gate inputted through a third switching element as input, and output of the third logic gate becomes output of the flip-flop. A fourth logic gate receives the clear signal and the output of the third logic gate, and the output terminal of the fourth logic gate is coupled via a fourth switching element to the output of the first logic gate inputted through the third switching element.

In addition, the selection controller may further generate reset signals for setting initial values of the scan driving units. The first and the fourth logic gates preferably further receive the reset signals as inputs.

Furthermore, the buffer unit preferably includes a fifth logic gate receiving output of the flip-flop and the clear signal. The buffer unit may include an inverter coupled to output terminal of the fifth logic gate and a buffer coupled to output terminal of the inverter.

The first to the fifth logic gates are preferably composed of the same conductive type thin film transistors.

The first to the fifth logic gates are NOR gates, which may be composed of PMOS transistors. Or, the first to the fifth logic gates are NAND gates, which may be composed of NMOS transistors.

A method of driving the organic EL display in accordance with the present invention includes: dividing the scan driver into a plurality of scan driving units, applying a first clear signal, with level for making outputs of the logic gates constant regardless of other inputs, to the other scan driving units while the selection signal is generated from a n-th scan driving unit, and applying a second clear signal with level opposite to that of the first clear signal to the n-th scan driving unit; applying the second clear signal to a (n+1)-th scan driving unit adjacent to the n-th scan driving unit before the (n+1)-th scan driving unit receives the selection signal outputted from the last flip-flop of the n-th scan driving unit; and applying the first clear signal to the n-th scan driving unit when the selection signal begins to be outputted from the (n+1)-th scan driving unit.

In addition, a reset signal for setting an initial value of the (n+1)-th scan driving unit may be applied thereto before the second clear signal is applied to the (n+1)-th scan driving unit.

The logic gates are preferably NOR gates composed of PMOS transistors. Or, the logic gates are NAND gates composed of NMOS transistors.

DETAILED DESCRIPTION

Figure 1A:
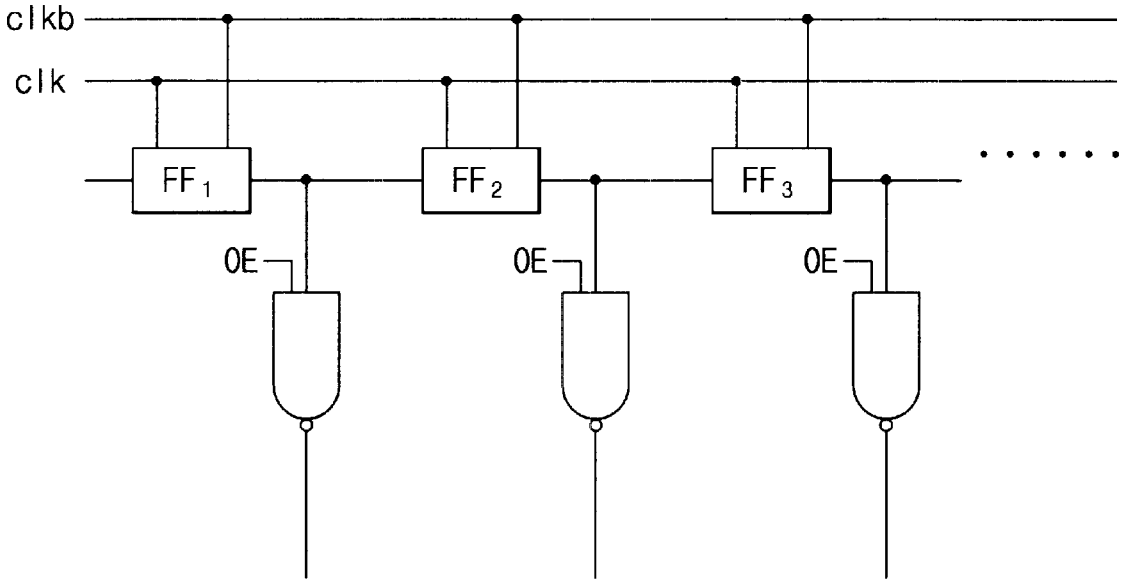
Fig. 1A (Prior Art)
FIGS. 1A and 1B are circuit diagrams illustrating a scan driver and a flip-flop according to the prior art, respectively.
Figure 1B:
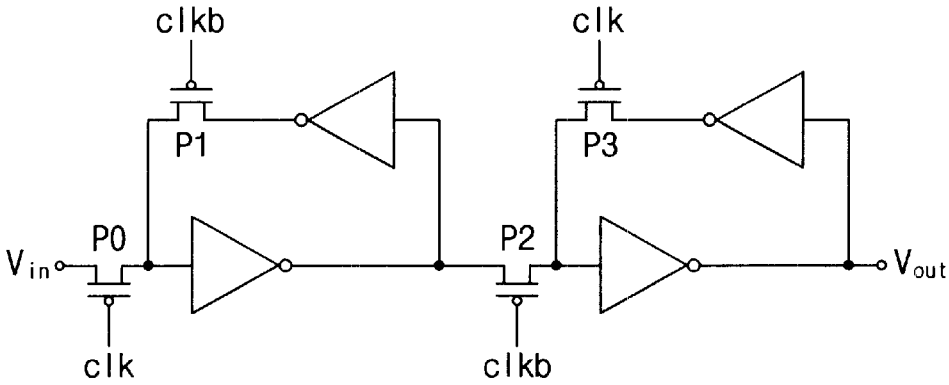
Fig. 1B (Prior Art)
Figure 2A:
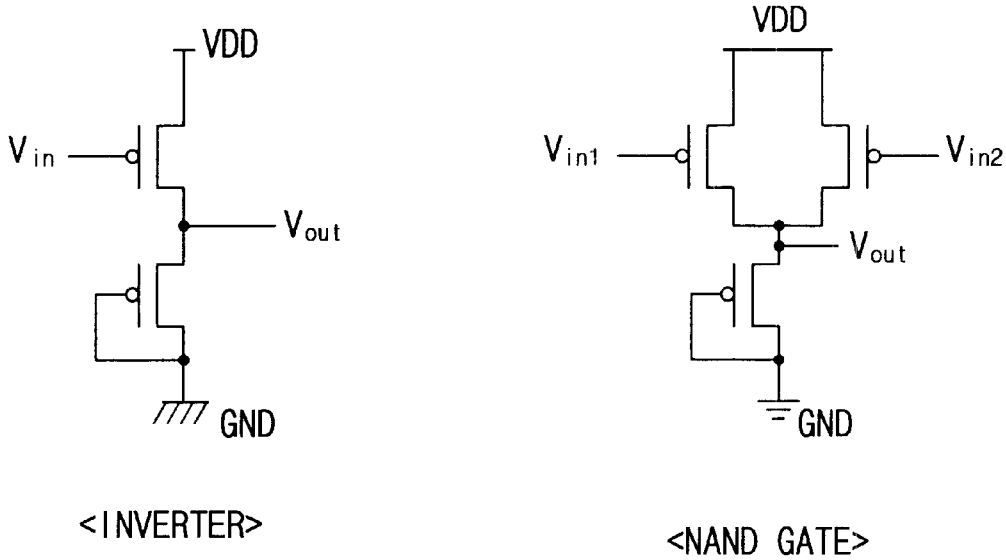
Fig. 2A (Prior Art)
FIGS. 2A and 2B are circuit diagrams illustrating output parts where static currents are generated in case of using PMOS transistors or NMOS transistors in an inverter or a NAND gate in a scan driver according to the prior art, respectively.
Figure 2B:
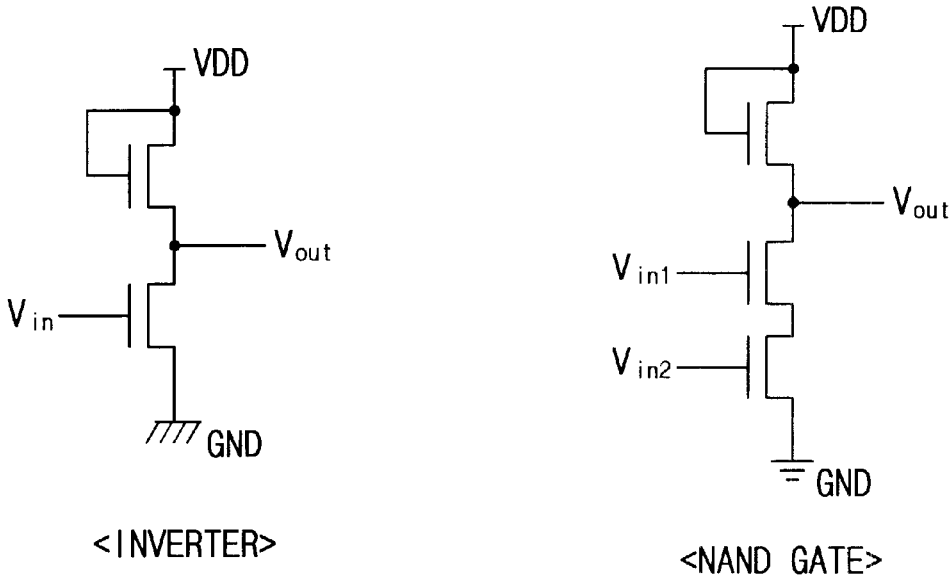
Fig. 2B (Prior Art)

In the specification, similar parts are denoted by the same reference numerals. When a part is connected to another part, the part is not only directly connected to another part but is also electrically connected (coupled) to another part while another device intervenes between them.

First, referring to FIGS. 3 and 4, an organic EL display and a scan driver thereof according to a first embodiment of the present invention will be described in detail.

Figure 3:
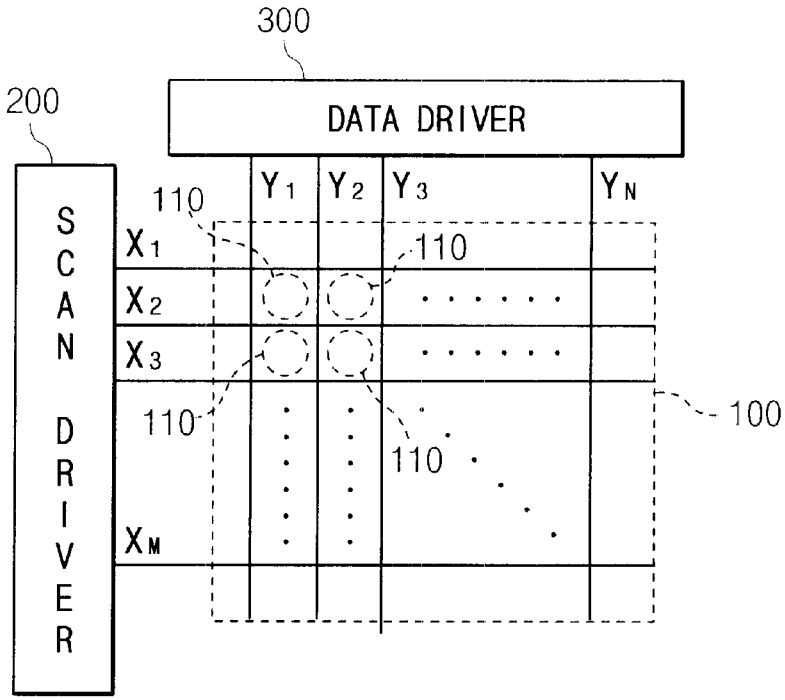
FIG. 3 is a diagram illustrating an organic EL display according to an embodiment of the present invention.

FIG. 3 is a diagram illustrating an organic EL display according to the first embodiment of the present invention. FIG. 4 is a diagram illustrating a scan driver of the organic EL display according to the first embodiment of the present invention.

As shown in FIG. 3, the organic EL display according to the first embodiment of the present invention includes organic EL display panel 100, scan driver 200, and data driver 300.

Organic EL display panel 100 includes a plurality of data lines $Y_1$ to $Y_N$ transmitting data signals (data voltages or data currents) representing image signals, a plurality of scan lines transmitting selection signals $X_1$ to $X_M$, and a plurality of pixel circuits 110. Transistors connected to the scan lines are PMOS transistors in order to be used as normally off switches in organic EL display panel 100. Pixel circuits 110 are provided in pixel areas defined by two adjacent data lines and two adjacent scan lines.

Scan driver 200 applies the selection signals to scan lines $X_1$ to $X_M$, and data driver 300 applies the data signals representing image signals to data lines $Y_1$ to $Y_N$.

Figure 4:
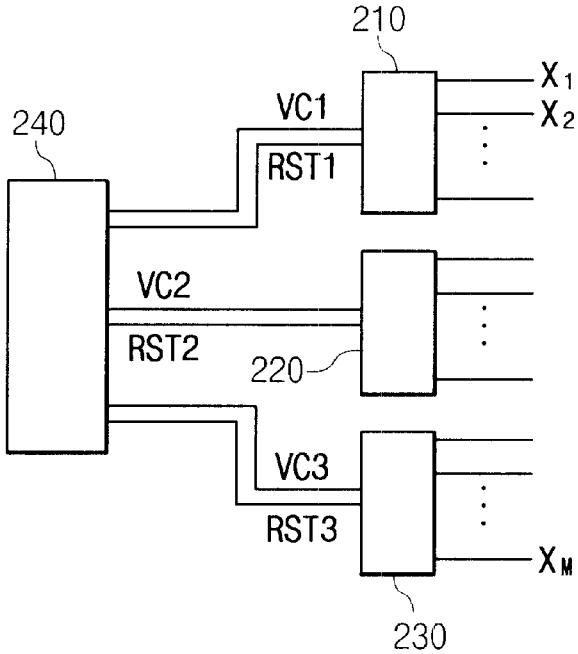
FIG. 4 is a diagram illustrating a scan driver of the organic EL display according to an embodiment of the present invention.

As shown in FIG. 4, scan driver 200 according to the first embodiment of the present invention includes first to third scan driving units 210, 220, and 230 and block selecting controller 240.

First to third scan driving units 210, 220, and 230 are to divide a conventional driver into three parts. Such division is not to be limited to three parts and can be divided into several parts as configurations and operations that may be different according to the number of parts are apparent to those skilled in the art, and thus, description thereof will be omitted. For example, in case a scan driver of 240 outputs is divided into three parts, each of first to third scan driving units 210, 220, and 230 becomes a scan driving unit of 80 outputs.

Block selecting controller 240 outputs clear signals VC1, VC2, and VC3 for removing static currents and reset signals RST1, RST2, and RST3 for setting initial values of the first to third scan driving unit 210, 220, and 230 to control operations of the first to third scan driving unit 210, 220, and 230.

Hereinafter, referring to FIG. 5 to FIG. 9 the scan driving unit will be described in detail.

Figure 5:
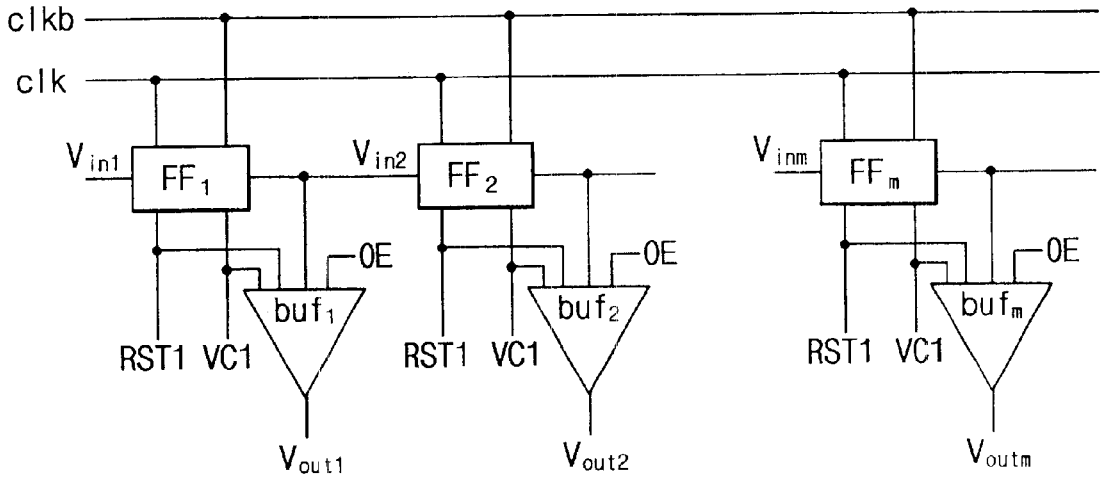
FIG. 5 is a circuit diagram illustrating a first scan driving unit according to an embodiment of the present invention.
Figure 6:
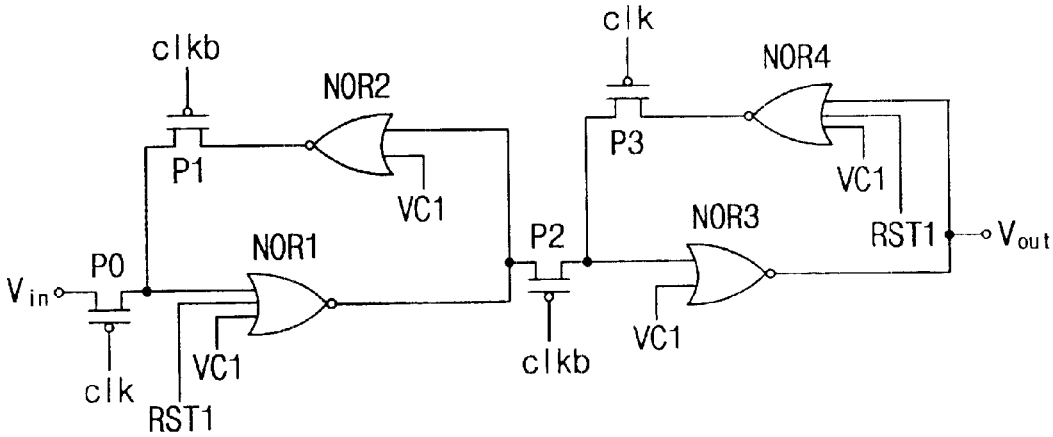
FIG. 6 is a circuit diagram illustrating a flip-flop according to an embodiment of the present invention.

FIG. 5 is a circuit diagram illustrating a first scan driving unit according to an embodiment of the present invention. FIG. 6 is a circuit diagram illustrating a flip-flop according to an embodiment of the present invention.

Figure 7A:
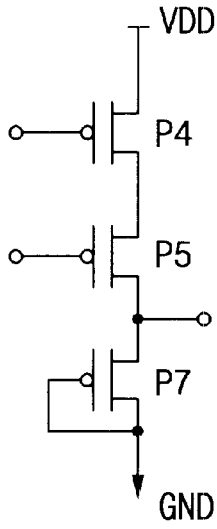
FIGS. 7A and 7B are circuit diagrams illustrating 2-input and 3-input NOR gates used in a flip-flop according to an embodiment of the present invention, respectively.
Figure 7B:
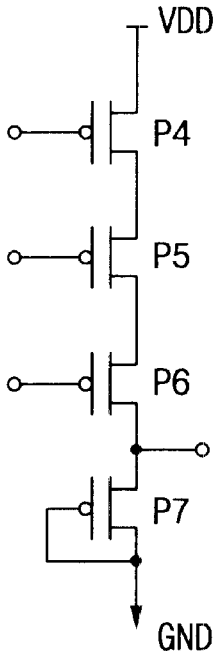
Figure 8:
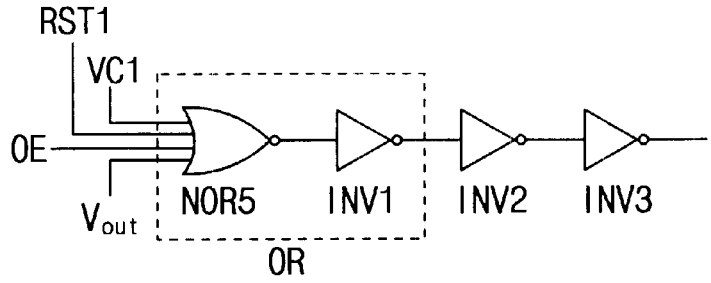
FIG. 8 is a circuit diagram illustrating a buffer unit according to an embodiment of the present invention schematically.
Figure 9:
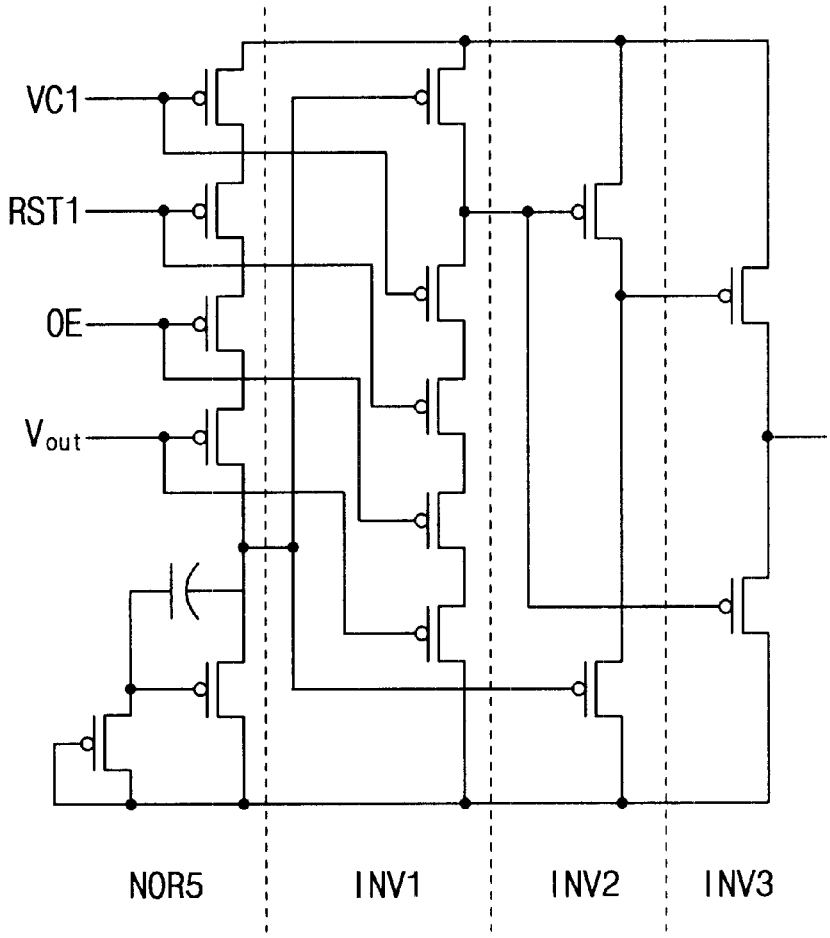
FIG. 9 is a circuit diagram illustrating the buffer unit according to an embodiment of the present invention in detail.

FIGS. 7A and 7B are circuit diagrams illustrating 2-input and 3-input NOR gates used in the flip-flop according to an embodiment of the present invention. FIG. 8 is a circuit diagram illustrating a buffer unit according to an embodiment of the present invention. FIG. 9 is a circuit diagram illustrating the buffer unit according to an embodiment of the present invention in detail.

As shown in FIG. 5, first scan driving unit 210 is composed of a plurality of flip-flops $FF_1$ to $FF_m$ and a plurality of buffers $buf_1$ to $buf_m$ having the outputs of the flip-flops as the inputs. Flip-flops $FF_1$ to $FF_m$ have an input signal $V_{in}$, clock signals clk and clkb, and clear signal VC1 as inputs. Each of the buffer units $buf_1$ to $buf_m$ includes an OR gate and a buffer having the output of the OR gate as the input, and the OR gate has an OE signal, output $V_{out}$ of the flip-flop, and clear signal VC1 as inputs.

In the first embodiment of the present invention to divide the scan driver, which applies selection signals to M scan lines $X_1$ to $X_M$, into scan driving units 210, 220 and 230 of three parts, the number (m) of flip-flops $FF_1$ to $FF_m$ and the number (m) of buffer unit $buf_1$ to $buf_m$ of first scan driving unit 210 correspond to M/3, respectively.

One of the flip-flops FF of flip-flips $FF_1$ to $FF_m$, as shown in FIG. 6, is composed of two 2-input NOR gates NOR2 and NOR3 and two 3-input NOR gates NOR1 and NOR4, and clear signal VC1 is inputted to all of NOR gates NOR1 to NOR4 and reset signal RST1 is inputted only to 3-input NOR gates, NOR1 and NOR4.

In detail, NOR gate NOR1 of flip-flop FF receives not only clear signal VC1 and reset signal RST1 but also output $V_{out}$ of the previous flip-flop via PMOS transistor P0 turned on/off by clock clk, as $V_{in}$. The output of NOR gate NOR1 becomes the input of NOR gate NOR2 together with clear signal VC1, and the output of NOR gate NOR2 is connected to the drain of PMOS transistor P0 via PMOS transistor P1 turned on/off by clock clkb. In addition, the output of NOR gate NOR1 is inputted to NOR gate NOR3 together with clear signal VC1 via PMOS transistor P2 turned on/off by clock clkb.

The output of NOR gate NOR3 is inputted to NOR gate NOR4 together with clear signal VC1 and reset signal RST1, and the output of NOR gate NOR4 is connected to the drain of PMOS transistor P2 via PMOS transistor P3 turned on/off by clock clk. In addition, the output of NOR gate NOR3 becomes output $V_{out}$ of flip-flop FF to be input $V_{in}$ of adjacent flip-flop.

The 2-input NOR gates NOR2 and NOR3 and 3-input NOR gates NOR1 and NOR4 may be configured, for example, as shown in FIGS. 7A and 7B.

As shown in FIG. 7A, each of 2-input NOR gates NOR2 and NOR3 is composed of 3 PMOS transistors, and the two inputs of NOR gates NOR2 and NOR3 are connected to the gates of PMOS transistors P4 and P5, respectively. The source of PMOS transistor P4 is connected to power source VDD, and the drain thereof is connected to the source of PMOS transistor P5. The drain of PMOS transistor P5 becomes the output of the NOR gate, and this drain is connected to the source of PMOS transistor P7. The gate and the drain of PMOS transistor P7 are connected with each other to be grounded.

As shown in FIG. 7B, 3-input NOR gates NOR1 and NOR4 further includes PMOS transistor P6 of which the gate is connected to one input of the 3-input NOR gate between PMOS transistors P5 and P7 of the 2-input NOR gate shown in FIG. 7A.

The flip-flop configured as above works as a shift register to transmit input $V_{in}$ to the next flip-flop by the turning on/off of transistors in synchronization with the cycles of clocks clk and clkb.

In addition, in one buffer unit buf of buffer units $buf_1$ to $buf_m$, as shown in FIG. 8, the OR gate is composed of NOR gate NOR5 and an inverter INV1, and the buffer is composed of two inverters INV2 and INV3. Herein, NOR gate NOR5 and inverters INV1, INV2 and INV3 are composed of, for example, PMOS transistors as shown in FIG. 9.

The second and third scan driving units 220 and 230 have the same configurations as the first scan driving unit except that clear signals VC2 and VC3 and reset signals RST2 and RST3 are inputted as a clear signal and a reset signal, respectively. Thus, a detailed description thereof will be omitted.

Next, referring to FIG. 10, a driving method of the scan driver according to the first embodiment of the present invention will be described.

Figure 10:
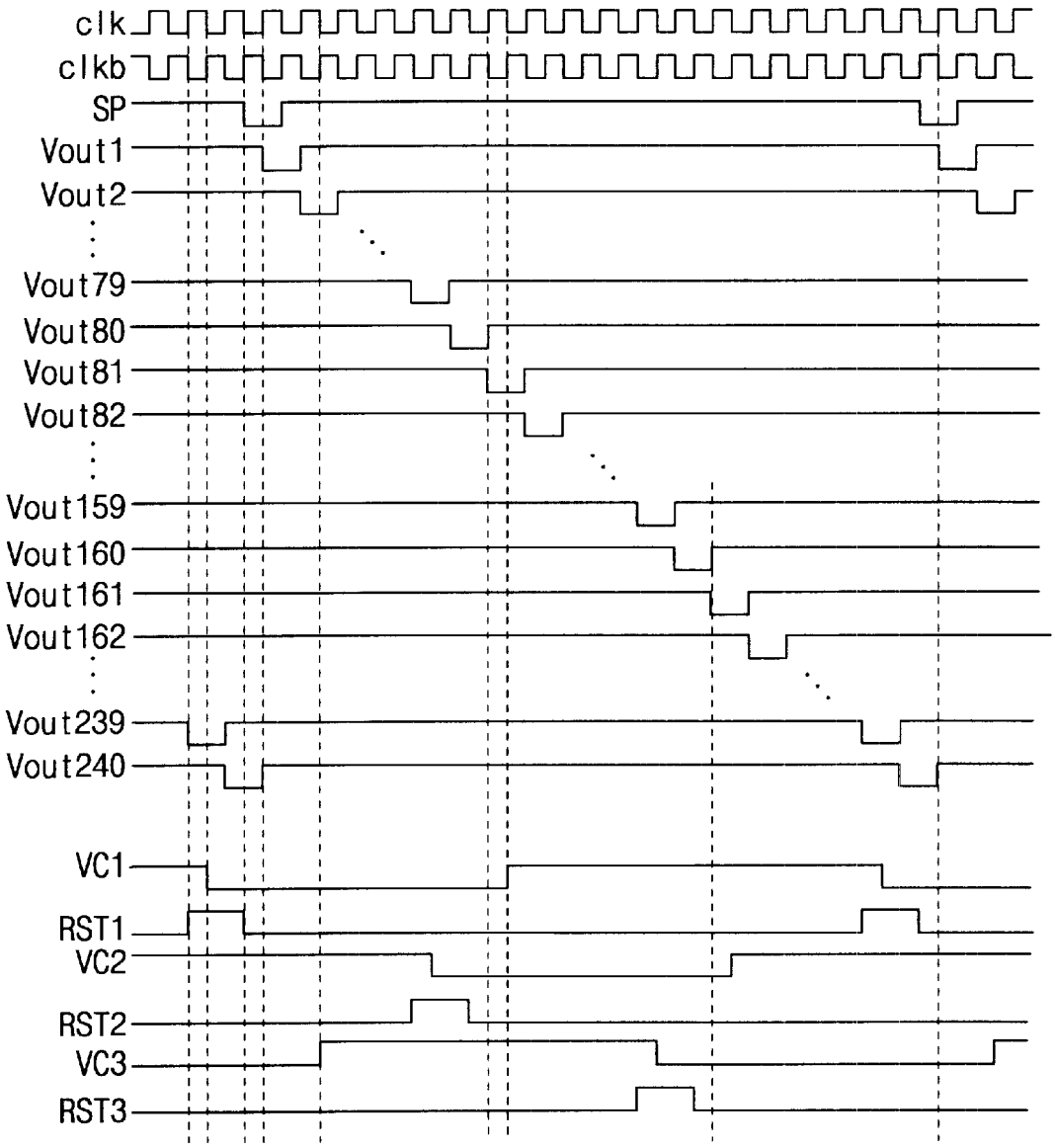
FIG. 10 is a timing diagram of a scan driver according to an embodiment of the present invention.

FIG. 10 is a timing diagram of input/output waveforms of the scan driving unit according to the first embodiment of the present invention.

As shown in FIG. 10, while the selection signal of low level turning on pixel circuit is outputted from first scan driving unit 210, that is, one of outputs $V_{out1}$ to $V_{out80}$ of the first scan driving unit is low level, clear signal VC1 inputted to first scan driving unit 210 is low level, and clear signals VC2 and VC3 inputted to second and third scan driving units 220 and 230 are high levels.

In addition, while one of outputs $V_{out80}$ to $V_{out160}$ of second scan driving unit 220 is low level, clear signal VC2 inputted to second scan driving unit 220 is low level, and clear signals VC1 and VC3 are high levels. While one of outputs $V_{out161}$ to $V_{out240}$ of third scan driving unit 230 is low level, clear signal VC3 inputted to third scan driving unit 230 is low level, and clear signals VC1 and VC2 are high levels.

When the clear signal is high level as above, the outputs of the NOR gate, which is composed of the PMOS transistors in flip-flop FF as shown in FIGS. 7A and 7B, are always low levels, and the static currents do not flow to the GND side. In addition, as shown in FIG. 9, the outputs of the NOR gate, which is composed of the PMOS transistors forming the OR gate of buffer unit buf, are also low levels, and the static currents do not flow as described in the prior art. In this way, by inputting the clear signal to the scan driving unit, which does not output the selection signal turning on the pixel circuit, it is possible to remove the static currents.

Next, a process to shift from first scan driving unit 210 to second driving unit 220 will be described.

Second scan driving unit 220 receives last output $V_{out80}$ of first scan driving unit 210 to perform an operation. Although clear signal VC1 is low level till the end of the pulse of last output $V_{out80}$ thereof, clear signal VC1 is kept to be low level for another half clock for an operation margin of a circuit. In addition, while first scan driving unit 210 is operating, reset signal RST2 are inputted thereto prior to input $V_{out80}$ of second scan driving unit 220 by one clock in order to set an initial value of second driving unit 220 cleared by clear signal VC2 of high level. And, the clear signal is kept low level in order to operate second scan driving unit 220. Reset signal RST2 is inputted thereto prior to clear signal VC2 by more than half clock for an operation margin of a circuit.

In addition, a process to shift from second scan driving unit 220 to third scan driving unit 230 is the same as the process to shift from first scan driving unit 210 to second scan driving unit 220, and thus, the description thereof will be omitted.

Next, the organic EL display, a scan driver, and a driving method thereof according to a second embodiment of the present invention will be described.

The organic EL display and the scan driver thereof according to the second embodiment of the present invention are the same as that of the first embodiment except that logic circuits are composed of NMOS transistors instead of PMOS transistors.

In detail, the first embodiment using PMOS transistors employs signals of high levels as clear signals VC1, VC2, and VC3 for removing the static currents and configures logic circuits by using NOR gate, of which the output is always fixed with low level when a signal of high level is inputted. On the contrary, the second embodiment using the NMOS transistors employs signals of low level as clear signals VC1, VC2, and VC3 for removing the static currents and configures logic circuits by using NAND gate, of which the output is always fixed with high level when a signal of low level is inputted.

In other words, flip-flops $FF_1$ to $FF_m$ are composed of NAND gates NAND1 to NAND4 and NMOS transistors instead of NOR gates NOR1 to NOR4 and PMOS transistors. Buffer units $buf_1$ to $buf_m$ are formed using an AND gate and a buffer. The AND gate is composed of a NAND gate and an inverter, and the buffer is composed of two inverters.

More detailed configurations and driving method thereof are apparent to those skilled in the art through previous description, and thus, the description thereof will be omitted.

In addition, although reset signals RST1, RST2, and RST3 are applied to first to third scan driving units 210, 220, and 230 in order to set initial values thereof, the reset signal may be not applied thereto in a practical operation of a circuit.

Since, in the present invention, the scan driver is divided into several parts to be driven and the clear signals are applied to non-operating units, it is possible to reduce the static currents flowing through the load, and accordingly, to decrease a power consumption.

Although specific embodiments of the present invention have been described in detail hereinabove, it should be clearly understood that many variations and/or modifications of the basic inventive concepts taught herein which may be apparent to those skilled in the present art will still fall within the spirit and scope of the present invention, as defined in the appended claims.

What is claimed is:

1. An organic electroluminescence display comprising:

an organic electroluminescence display panel having a plurality of scan lines transmitting selection signals, a plurality of data lines transmitting data signals representing image signals, and a plurality of pixel circuits coupled to the scan lines and the data lines;

a data driver applying the data signals to the data lines; and a scan driver outputting the selection signals to the scan lines selectively, wherein the scan driver includes:

more than two scan driving units having a plurality of flip-flops coupled with each other in series and composed of a plurality of logic gates provided by any one of NOR gates and NAND gates and a plurality of switching elements, and a plurality of buffer units receiving outputs of the flip-flops to respectively drive the scan lines; and a selection controller generating a clear signal for keeping outputs of the logic gates of a scan driving unit as a constant value for the scan driving unit not to output the selection signal.

2. The organic electroluminescence display of claim 1, wherein the selection controller further generates reset signals for setting initial values of the scan driving units.

3. The organic electroluminescence display of claim 1, wherein the flip-flop includes:

a first logic gate receiving the clear signal and an output of previous flip-flop inputted through a first switching element, as an input;

a second logic gate receiving the output of the first logic gate and the clear signal as an input, and an output terminal of the second logic gate is coupled via a second switching element to the output terminal of the previous flip-flop inputted via the first switching element;

a third logic gate receiving the clear signal and the output of the first logic gate inputted via a third switching element as an input, and an output of the third logic gate becomes output of the flip-flop; and a fourth logic gate receiving the clear signal and the output of the third logic gate, and an output terminal of the fourth logic gate is coupled via a fourth switching element and the third switching element to the output terminal of the first logic gate.

4. The organic electroluminescence display of claim 3, wherein the selection controller further generates reset signals for setting initial values of the scan driving units, and wherein the first logic gate and the fourth logic gate further receive the reset signals as the inputs.

5. The organic electroluminescence display of claim 4, wherein the buffer unit includes a fifth logic gate receiving the output of the flip-flop, the clear signal, and the reset signal as an input.

6. The organic electroluminescence display of claim 5, wherein the buffer unit further comprises an inverter coupled to an output terminal of the fifth logic gate and a buffer coupled to an output terminal of the inverter.

7. The organic electroluminescence display of claim 5, wherein the first to the fifth logic gates are composed of the same conductive type thin film transistors.

8. The organic electroluminescence display of claim 5, wherein the first to the fifth logic gates are NOR gates, and thin film transistors forming the NOR gates are PMOS transistors.

9. The organic electroluminescence display of claim 7, wherein the first to the fifth logic gates are NAND gates, and thin film transistors forming the NAND gates are NMOS transistors.

10. A method of driving an organic electroluminescence display having an organic electroluminescence display panel including a plurality of scan lines, a plurality of data lines, and a plurality of pixels arranged in a matrix; and a scan driver outputting the selection signals to the scan lines, and having a plurality of flip-flops receiving the outputs of adjacent flip-flops as inputs, respectively, and composed of a plurality of logic gates provided by NOR gates or NAND gates, and a plurality of buffer units receiving outputs of the flip-flops to drive the scan lines, the method comprising:

(a) dividing the scan driver into a plurality of scan driving units, to apply a first clear signal with level for making outputs of the logic gates constant regardless of other inputs, to the other scan driving, while the selection signal is outputted from a n-th scan driving unit, and applying a second clear signal with level opposite to that of the first clear signal to the n-th scan driving unit;

(b) applying the second clear signal to a (n+1)-th scan driving unit adjacent to the n-th scan driving unit before the (n+1)-th scan driving unit receives the selection signal outputted from the last flip-flop of the n-th scan driving unit; and (c) applying the first clear signal to the n-th scan driving unit when the selection signal begins to be outputted from the (n+1)-th scan driving unit.

11. The method of claim 10, wherein the step (b) further comprises the step applying a reset signal for setting an initial value of the (n+1)-th scan driving unit before the second clear signal is applied to the (n+1)-th scan driving unit.

12. The method of claim 10, wherein the logic gates are NOR gates composed of PMOS transistors.

13. The method of claim 10, wherein the logic gates are NAND gates composed of NMOS transistors.

14. A driving apparatus for driving an organic electroluminescence display by applying selection signals to scan lines of an organic electroluminescence display panel having a plurality of scan lines, a plurality of data lines, and a plurality of pixel circuits, the driving apparatus comprising:

more than two scan driving units having a plurality of flip-flops coupled with each other in series and composed of a plurality of logic gates provided by of NOR gates or NAND gates and a plurality of switching elements, and a plurality of buffer units receiving outputs of the flip-flops to respectively drive the scan lines; and a selection controller generating a clear signal for keeping outputs of the logic gates of a scan driving unit as a constant value for the scan driving unit not to output the selection signal.

15. The driving apparatus of the organic electroluminescence display of claim 14, wherein the selection controller further generates reset signals for setting initial values of the scan driving units.

16. The driving apparatus of the organic electroluminescence display of claim 14, wherein the flip-flop includes:

a first NOR gate receiving the clear signal and an output of previous flip-flop, inputted through a first switching element, as an input;

a second NOR gate receiving the output of the first NOR gate and the clear signal as an input, and an output terminal of the second NOR gate is coupled via a second switching element to the output terminal of the previous flip-flop inputted via the first switching element;

a third NOR gate receiving the clear signal and the output of the first NOR gate inputted via a third switching element as an input, and an output of the third NOR gate becomes output of the flip-flop; and a fourth NOR gate receiving the clear signal and the output of the third NOR gate, and an output terminal of the fourth NOR gate is coupled via a fourth switching element and the third switching element to the output terminal of the first NOR gate, wherein the buffer unit includes a fifth NOR gate receiving the output of the flip-flop and the clear signal as an input, wherein the first to the fifth NOR gates are composed of PMOS transistors.

17. The driving apparatus of the organic electroluminescence display of claim 16, wherein the selection controller further generates reset signals for setting initial values of the scan driving units, wherein the first NOR gate, the fourth NOR gate, and the fifth NOR gate further receive the reset signals as the inputs.

18. The driving apparatus of the organic electroluminescence display of claim 14, wherein the flip-flop includes:

a first NAND gate receiving the clear signal and an output of previous flip-flop, inputted through a first switching element, as an input;

a second NAND gate receiving the output of the first NAND gate and the clear signal as an input, and an output terminal of the second NAND gate is coupled via a second switching element to the output terminal of the previous flip-flop inputted via the first switching element;

a third NAND gate receiving the clear signal and the output of the first NAND gate inputted via a third switching element as an input, and an output of the third NAND gate becomes output of the flip-flop; and a fourth NAND gate receiving the clear signal and the output of the third NAND gate, and an output terminal of the fourth NAND gate is coupled via a fourth switching element and the third switching element to the output terminal of the first NAND gate, wherein the buffer unit includes a fifth NAND gate receiving the output of the flip-flop and the clear signal as an input, wherein the first to the fifth NAND gates are composed of NMOS transistors.

19. The driving apparatus of the organic electroluminescence display of claim 18, wherein the selection controller further generates reset signals for setting initial values of the scan driving units, wherein the first NAND gate, the fourth NAND gate, and the fifth NAND gate further receive the reset signals as the inputs.

* * * * *